US011583078B2

(12) United States Patent
Moscoso et al.

(10) Patent No.: US 11,583,078 B2
(45) Date of Patent: Feb. 21, 2023

(54) EXTENDABLE DRAWER SLIDE

(71) Applicant: Accuride International Inc., Santa Fe Springs, CA (US)

(72) Inventors: Wyatt X. Moscoso, Santa Fe Springs, CA (US); Raffy Paje, Santa Fe Springs, CA (US); Lucas Nielsen, Santa Fe Springs, CA (US)

(73) Assignee: Accuride International, Inc., Sante Fe Springs, CA (US)

( * ) Notice: Subject to any disclaimer, the term of this patent is extended or adjusted under 35 U.S.C. 154(b) by 12 days.

(21) Appl. No.: 16/985,152

(22) Filed: Aug. 4, 2020

(65) Prior Publication Data

US 2022/0039552 A1 Feb. 10, 2022

(51) Int. Cl.

| | |
|---|---|
| ***A47B 88/477*** | (2017.01) |
| ***A47B 88/493*** | (2017.01) |
| ***A47B 88/487*** | (2017.01) |
| ***A47B 88/43*** | (2017.01) |

(52) U.S. Cl.

CPC ..... *A47B 88/477* (2017.01); *A47B 88/43* (2017.01); *A47B 88/487* (2017.01); *A47B 88/493* (2017.01)

(58) Field of Classification Search

CPC ... A47B 88/477; A47B 88/493; A47B 88/487; A47B 88/43

See application file for complete search history.

(56) References Cited

U.S. PATENT DOCUMENTS

| | | | | |
|---|---|---|---|---|
| 2,687,924 A | | 8/1954 | Gomersall | |
| 4,200,342 A | * | 4/1980 | Fall | A47B 88/493 384/19 |
| 4,983,000 A | * | 1/1991 | Rock | A47B 88/467 312/334.4 |
| 4,998,828 A | * | 3/1991 | Hobbs | A47B 88/493 312/334.46 |
| 5,211,461 A | * | 5/1993 | Teufel | A47B 88/417 312/334.44 |
| 5,520,452 A | | 5/1996 | Petersen et al. | |

(Continued)

FOREIGN PATENT DOCUMENTS

| | | |
|---|---|---|
| CN | 203897768 | 10/2014 |
| DE | 4005406 A1 | 9/1990 |

(Continued)

OTHER PUBLICATIONS

International Search Reporton PCT Application No. PCT/US2021/044550 from International Searching Authority (KIPO) dated Dec. 20, 2021.

(Continued)

*Primary Examiner* — Hanh V Tran
(74) *Attorney, Agent, or Firm* — Kos IP Law LLP

(57) ABSTRACT

A drawer slide may include features for installation of the drawer slide to a cabinet and/or features for withdrawing rails of the drawer slide from one another. The features for installation of the drawer slide may include offset surfaces in a web of a rail, for example allowing for clearance for mounting hardware, and/or openings allowing for various positioning of the rail on a cabinet. The features for withdrawing rails from one another may include a moveable disconnect lever allowing for release of a catch of a rail, and/or a moveable hook.

14 Claims, 25 Drawing Sheets

(56) References Cited

U.S. PATENT DOCUMENTS

| | | | | |
|---|---|---|---|---|
| 5,871,264 | A * | 2/1999 | Ohara | A47B 88/941 312/334.7 |
| 6,257,683 | B1 * | 7/2001 | Yang | A47B 88/487 312/334.46 |
| 6,655,763 | B2 * | 12/2003 | Judge | A47B 88/493 312/334.46 |
| 6,702,412 | B2 * | 3/2004 | Dobler | A47B 88/43 312/334.5 |
| 6,820,954 | B2 | 11/2004 | Judge et al. | |
| 6,902,069 | B2 * | 6/2005 | Hartman | H05K 7/1491 361/826 |
| 6,938,967 | B2 | 9/2005 | Dubon et al. | |
| 7,008,030 | B2 * | 3/2006 | Yang | A47B 88/40 312/334.44 |
| 7,699,415 | B2 * | 4/2010 | Tseng | A47B 88/493 312/334.45 |
| 8,147,011 | B2 * | 4/2012 | Chen | F16C 29/04 312/334.44 |
| 8,444,236 | B2 | 5/2013 | Netzer | |
| 8,590,991 | B2 | 11/2013 | Radusin | |
| 9,301,609 | B2 | 4/2016 | Muller et al. | |
| 10,165,858 | B1 * | 1/2019 | Chen | F16C 29/045 |
| 10,231,540 | B1 * | 3/2019 | Hong | E05B 65/46 |
| 10,743,661 | B1 * | 8/2020 | Wu | A47B 96/06 |
| 11,060,558 | B2 * | 7/2021 | Chen | F16C 29/04 |
| 11,246,410 | B2 * | 2/2022 | Chen | A47B 88/57 |
| 11,272,784 | B2 * | 3/2022 | Meusburger | A47B 88/45 |
| 2007/0247043 | A1 * | 10/2007 | Simmons | A47L 15/0084 312/334.1 |
| 2010/0027923 | A1 | 2/2010 | Bonat | |
| 2011/0012492 | A1 * | 1/2011 | Radusin | A47B 88/43 312/334.8 |
| 2013/0039608 | A1 * | 2/2013 | Chen | A47B 88/493 384/20 |
| 2013/0156476 | A1 * | 6/2013 | Yokoyama | G03G 15/6529 399/361 |
| 2013/0259410 | A1 * | 10/2013 | Judge | A47B 88/493 384/49 |
| 2013/0334949 | A1 * | 12/2013 | Yokoyama | B65H 1/266 271/145 |
| 2014/0265795 | A1 * | 9/2014 | Muller | A47B 88/40 312/334.46 |
| 2014/0265796 | A1 * | 9/2014 | Rehage | A47B 88/493 312/334.46 |
| 2015/0091429 | A1 * | 4/2015 | Kruse | A47B 88/487 312/334.33 |
| 2015/0366346 | A1 * | 12/2015 | Raid | A47B 88/427 312/334.44 |
| 2017/0172300 | A1 * | 6/2017 | Bowman | A47B 88/487 |
| 2018/0295990 | A1 * | 10/2018 | Chen | A47B 88/443 |
| 2019/0174649 | A1 * | 6/2019 | Chen | A47B 88/43 |
| 2019/0200759 | A1 * | 7/2019 | Chen | H05K 7/1489 |
| 2020/0245766 | A1 * | 8/2020 | Rechberg | F16C 29/045 |
| 2020/0405053 | A1 * | 12/2020 | Park | A47B 88/483 |

FOREIGN PATENT DOCUMENTS

| | | | | |
|---|---|---|---|---|
| EP | 1795088 | B1 | 2/2012 | |
| EP | 2129260 | B1 | 8/2012 | |
| EP | 2716182 | A1 * | 4/2014 | A47B 88/57 |
| EP | 2716182 | B1 | 1/2015 | |
| JP | 6050314 | | 12/2016 | |

OTHER PUBLICATIONS

Written Opinion on PCT Application No. PCT/US2021/044550 from International Searching Authority (KIPO) dated Dec. 20, 2021.

* cited by examiner

EXTENDABLE DRAWER SLIDE

BACKGROUND OF THE INVENTION

The present invention relates generally to drawer slides, and more particularly to a drawer slide with installation and rail removal features.

Drawer slides are commonly used to extendably mount trays, drawers, and casings in a structure, for example trays or drawers in a cabinet or other frame. The use of drawer slides often allows for compact storage of the trays or drawers, while providing relative ease of user access to items in the trays or drawers when desired.

Unfortunately, at times installation of the drawer slides may pose difficulties. Drawer slides may often be used in a pair for any particular tray or drawer, and to increase smoothness of operation it may be preferable that the pair of drawer slides be similarly aligned. Installation with such alignment may take some care, and may be made more difficult if the pair of drawer slides is desired to have an alignment different than that of the cabinet or frame in which they are installed.

For some drawer slides, there may be reasons to allow for disassembly of some of their constituent parts. For example, a drawer slide may include multiple rails, with each rail extendable from another. Separation of the rails may therefore be desirable at particular times, for a variety of reasons. However, during normal operation of extension and retraction of a drawer, separation of the rails of the drawer slide may be highly undesirable.

BRIEF SUMMARY OF THE INVENTION

Some embodiments provide a drawer slide comprising a plurality of extendably coupled rails, including a first rail, for mounting to a cabinet, that includes at least one opening for receiving a fastener to support the rail with respect to the cabinet at a non-zero angle with respect to a base of the cabinet and for viewing a potential support position at a zero angle with respect to the base of the cabinet. In some embodiments the opening includes a plurality of support surfaces for engagement with the fastener, each support surface providing for placement of the fastener at a different position with respect to the rail.

Some embodiments provide a drawer slide comprising a plurality of extendably coupled rails, including a first rail for mounting to a cabinet, the first rail including a longitudinal web defining a first plane, with offset portions within the web extending outward from the first plane, at least some of the offset portions each including at least one aperture for receiving a fastener for fastening the rail to the cabinet. In some embodiments the offset portions extend from the first plane in a direction away from other rails of the drawer slide. In some embodiments a forward edge of the web includes an offset portion along an entire length of the forward edge of the web. In some embodiments the web is circumferentially bounded by offset portions. In some embodiments the offset portions circumferentially bounding the web extend a same distance from the first plane in a direction away from other rails of the drawer slide. In some embodiments a portion of a structure providing a raceway of the first rail is part of the offset portion of the forward edge of the web. In some embodiments a portion of a structure providing a raceway of the first rail is part of the offset portion circumferentially bounding the web.

Some embodiments provide a drawer slide comprising a first rail, a second rail extendably coupled to the first rail, a disconnect lever mounted on forward portion of first rail for constraining movement of the second rail in at least one direction, and a stop tab on the first rail for engaging a catch on the second rail to stop forward translation of second rail, with the disconnect lever movable to permit the second rail to be moved in the at least one direction to allow the catch to pass by the stop tab. In some embodiments the disconnect lever is movable in both a rotatable and translatable manner. In some embodiments the disconnect lever is translatable between a first position and a second position. In some embodiments the disconnect lever is not rotatable in the first position, but is rotatable in the second position. In some embodiments rotation of the disconnect lever when in the second position permits the second rail to be moved in the at least one direction to allow the catch to pass by the stop tab. In some embodiments another rail includes a feature to rotate the disconnect lever, from a position permitting the second rail to be moved in the at least one direction to a position not permitting the second rail to be moved in the at least one direction, during or at conclusion of relative retraction of the first rail and the other rail. In some embodiments the other rail is the second rail. In some embodiments another rail includes a feature to translate the disconnect lever from the second position to the first position during or at conclusion of relative retraction of the first rail and the other rail. In some embodiments the feature is an in-stop of the second rail. In some embodiments the second rail includes an in-stop positioned to contact the disconnect lever on closing of the slide and translate the disconnect lever from the second position to the first position. In some embodiments the in-stop is positioned to contact the disconnect lever on closing of the slide and rotate the disconnect lever from a position permitting the second rail to be moved in the at least one direction to a position constraining movement of the second rail in the at least one direction. In some embodiments the in-stop comprises an upturned portion of the upper raceway of the second rail.

Some embodiments provide a drawer slide comprising a first rail, an intrusion in a raceway of the first rail, a second rail extendably coupled to the first rail, a moveable hook mounted to the second rail, with a bend of the hook extending past a surface of a raceway of the second rail sufficiently far such that the intrusion in the raceway of the first rail is in a travel path of at least part of the hook with the hook in a first position, and out of the travel path of the hook with the hook moved to a second position.

These and other aspects of the invention are more fully comprehended upon review of this disclosure.

DETAILED DESCRIPTION

Figure 1A:
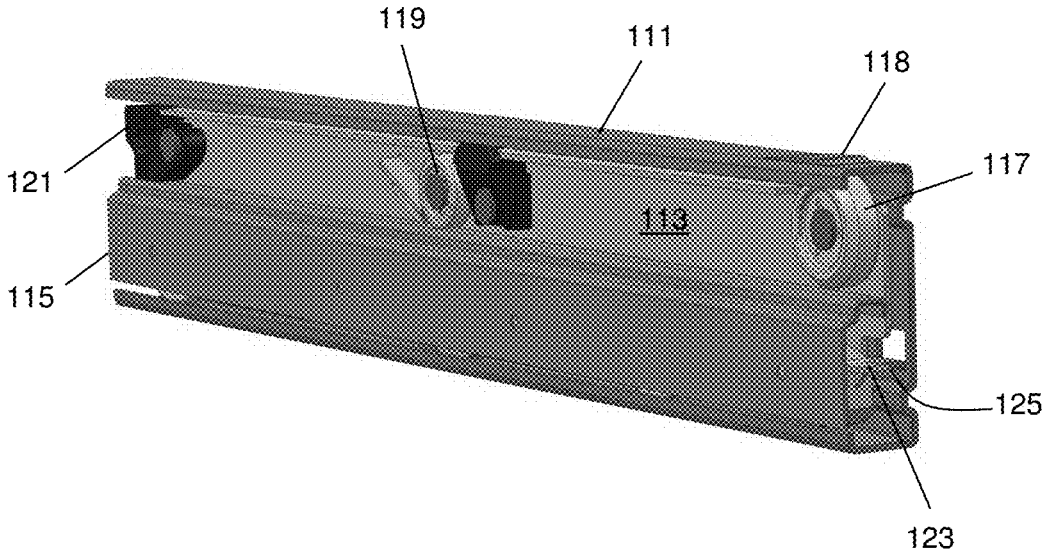
FIG. 1A is a perspective rear inner side view of a drawer slide in accordance with aspects of the invention in a closed or unextended position.

FIG. 1A is a perspective rear inner side view of a drawer slide in accordance with aspects of the invention in a closed or unextended position. The drawer slide of FIG. 1A is a three rail drawer slide, having an outer rail 111, an intermediate rail 113, and an inner rail 115. In some embodiments the drawer slide may be a two rail drawer slide, for example having an outer rail and an inner rail. The outer rail has a lengthwise longitudinal web, bounded longitudinally by opposing raceways. The intermediate rail is nested within the raceways of the outer rail, with the intermediate rail longitudinally extendable from the outer rail. The inner rail is longitudinally extendably coupled to the outer rail. In many embodiments the outer rail is mounted to an interior of a cabinet, with the inner rail mounted to a drawer or tray. Extension of the intermediate and inner rails withdraws the drawer or tray from the cabinet, at least partially, allowing for access to contents of the drawer or tray.

FIG. 1A also shows a rear upper roller 117 and a mid-rail roller 119. The rear upper roller is mounted to a rear of a longitudinal web of the intermediate rail, and is in rolling contact with an upper raceway of the outer rail, and, with the drawer slide in the closed position, an outside of an upper raceway of the inner rail. In some embodiments, and as shown in FIG. 1A, the upper raceway of the outer rail includes a partially punched out outwardly extending basin 118. The basin may receive the rear upper roller with the slide in the closed position, providing for example a detent with the drawer slide in the closed position, assisting the slide in maintaining the closed position. The mid-rail roller is also mounted to the longitudinal web of the intermediate rail, approximately mid-way along its longitudinal length. The mid-rail roller is in rolling contact with the upper raceway of the inner rail.

In some embodiments, and as shown in FIG. 1A, the drawer slide includes a forward disconnect lever 121 and/or a rear hook block 123. The forward disconnect lever is shown mounted to a front of the longitudinal web of the intermediate rail. The disconnect lever is in contact with an outer surface of the upper raceway of the inner rail, or close to contact with that outer surface in some embodiments. In the embodiment of FIG. 1A, a forward portion of the disconnect lever extends forward of a forward end of the upper raceway of the intermediate rail. In operation, the disconnect lever prevents a portion of the inner rail under the disconnect lever from being raised vertically with respect to the intermediate rail, or, more generally, being displaced, in one direction, in a plane parallel to the webs of the rails of the drawer slide.

The rear hook block 123 is shown in FIG. 1A as nested alongside the web of the inner rail, alongside the web of the intermediate rail. As will be discussed later, the hook block is mounted to the intermediate rail. In operation, a hook of the hook block engages a forward stop in the lower raceway of the outer rail to set an extent of extension of the intermediate slide from the outer rail. In FIG. 1A, a rearward extending tab of the hook block is visible. In some embodiments the tab may be used to lift the hook, allowing the hook to bypass the forward stop, such that the intermediate rail may be completely withdrawn from the outer rail.

FIG. 1A also shows a stop tab 125 extending from a rear of the web of the outer rail and towards the web of the inner rail. The stop tab may, for example, be lanced or formed from the web of the outer rail. The stop tab is in the travel path of the web of the intermediate rail and/or, in some embodiments, the rear hook block. The stop tab serves as a rear stop for motion of the intermediate rail.

Figure 1B:
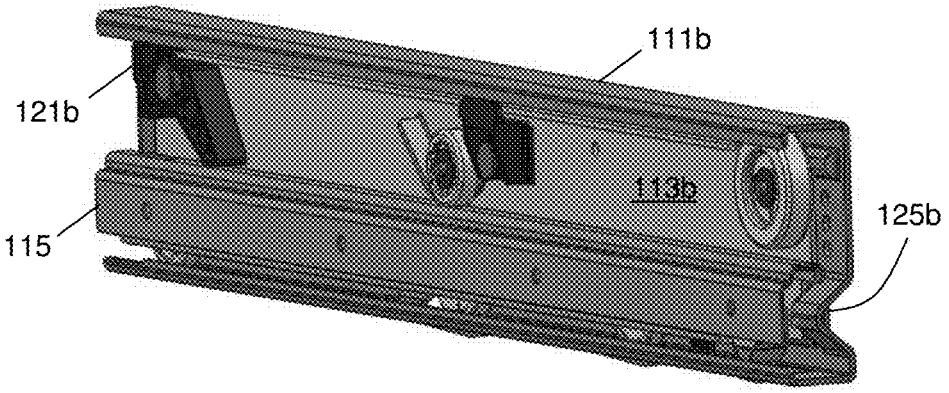
FIG. 1B is a perspective rear inner side view of a further drawer slide in accordance with aspects of the invention in a closed or unextended position.

FIG. 1B is a perspective rear inner side view of a further drawer slide in accordance with aspects of the invention in a closed or unextended position. The further drawer slide of FIG. 1B is similar to the drawer slide of FIG. 1A. Compared to the drawer slide of FIG. 1A, the drawer slide of FIG. 1B has an intermediate rail 113*b* of greater height than the intermediate rail of the slide of FIG. 1A, and an outer rail 111*b* also of greater height than the outer rail of the slide of FIG. 1A. The inner rail 115 of the drawer slide of FIG. 1B, however, is substantially the same as that of FIG. 1A. With the inner rail rollably mounted about a bottom of the intermediate rail, there is a greater distance separating a top of the inner rail and a top of the intermediate and outer rails for the drawer slide of FIG. 1B than for the drawer slide of FIG. 1A. To account for that difference, at least in part, in some embodiments the inner member disconnect lever 121*b* of the drawer slide of FIG. 1B is differently shaped than that of the drawer slide of FIG. 1A.

In addition, the drawer slide of FIG. 1B includes a V-shaped rear stop 125*b* at a rear end of the web of the outer rail, in place of the stop tab 125 of the drawer slide of FIG. 1A. The V-shaped rear stop is formed out of a lower rear edge of the web of the outer rail, in a horizontal V-shape. The horizontal V-shape has ends of the V-shape coupled to the web and sides of the V-shape angling toward each other, with a point of the V extending towards a web of the inner rail. The V extends into the travel path of the web of the intermediate rail, with the V serving as a rear stop for travel of the intermediate rail. Compared to the stop tab of the drawer slide of FIG. 1A, the V-shaped stop of the drawer slide of FIG. 1B is believed to be able to withstand greater impact forces in stopping travel of the intermediate rail as the drawer slide closes.

Figure 2A:
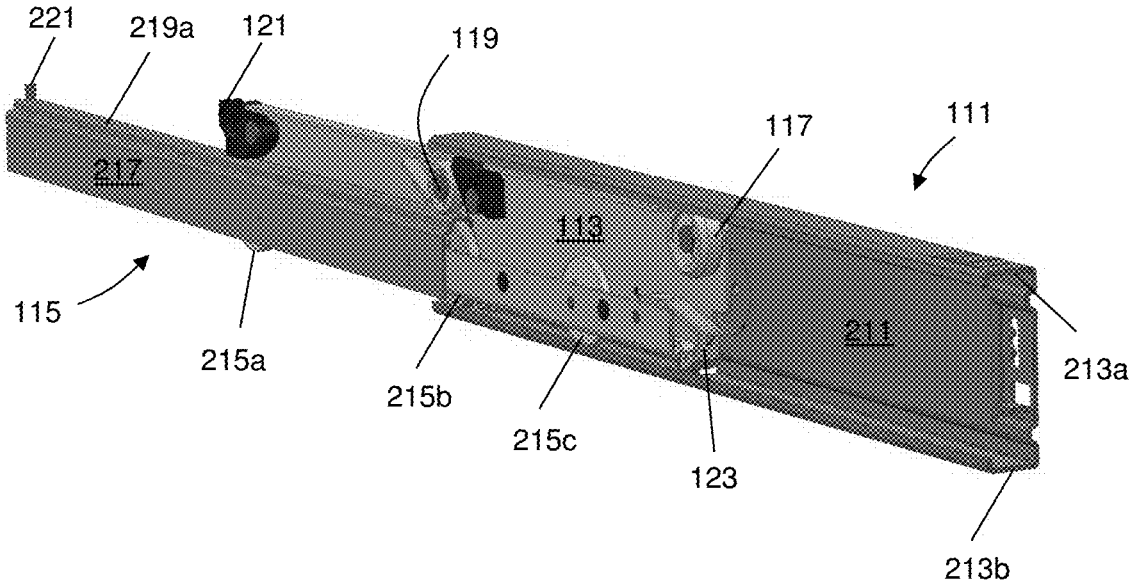
FIG. 2A is a perspective rear inner side view of the drawer slide of FIG. 1A in an open or extended position.

FIG. 2A is a perspective rear inner side view of the drawer slide of FIG. 1A in an open or extended position. In the open position, the intermediate rail 113 is longitudinally extended from the outer rail 111, and the inner rail 115 is longitudinally extended from the intermediate rail. For the embodiment of FIG. 1A, approximately half of the intermediate rail extends forward from the outer rail, and approximately half of the inner rail extends forward from the intermediate rail.

As may be seen in FIG. 2A, the outer rail includes a longitudinal web 211, bounded by opposing inward facing raceways 213*a,b* along longitudinal edges of the longitudinal web. The upper rear roller 117 mounted to the web of the intermediate rail is in rolling contact with the upper raceway 213*a* of the outer rail. Similarly, lower rollers 215*a-c* of the intermediate rail are positioned to be in rolling contact with the lower raceway 213*b* of the outer rail and in rolling contact with the upper raceway 219 of the inner rail. The lower rollers are positioned spread along the length of the intermediate rail; depending on extent of extension, different ones of the lower rollers may be in contact with both the lower raceway of the outer rail and the upper raceway of the inner rail, or only one of them, or, at times that may be often, none of them. For example, in FIG. 2A, a leading lower roller 215*a* is only in contact with the upper raceway of the inner rail, a mid-lower roller 215*b* is on contact with both the upper raceway of the inner rail and the lower raceway of the outer rail, and a lagging lower roller 215*c* is only in contact with the lower raceways of the outer rail. For the embodiment of FIG. 2A, the lower rollers may be mounted to the web of the intermediate rail, or mounted to an upturned flange, parallel to the web, of the intermediate rail.

With the slide in the extended position, relative motion of the inner rail with respect to the intermediate rail is constrained in directions parallel to the webs of the rails and orthogonal to directions of extension and closing of the slide. The lower rollers of the intermediate rail support the inner rail, and serve to limit motion on the inner rail in what may be considered a downward direction. The disconnect lever 121 mounted on the forward end of the intermediate rail serves to limit motion of the inner rail in what may be considered an upward direction, as does the mid-rail roller 119 of the intermediate rail. As will be later discussed, the disconnect lever 121 may be repositioned, such that a forward end of the inner rail may be raised in the upward direction, allowing for removal of the inner rail from the intermediate rail and drawer slide.

An in-stop 221 is at a forward end of the inner rail. In the embodiment of FIG. 2A, the in-stop is an upturned portion of the upper raceway of the inner rail. On retraction or closing of the drawer slide, travel of the inner rail is stopped by contact between the in-stop and a forward edge of the disconnect lever. In addition, the contact between the in-stop and the disconnect lever also repositions the disconnect lever to a locking position, as discussed later herein.

The rear hook block 123 is also partially visible in FIG. 2A. The rear hook block may be seen at a rear of the intermediate rail, partially in and mounted about the lower raceway of the intermediate rail, and partially extending beyond a rear edge of the intermediate mail. A hook of the hook block extends, just past the rear edge, towards the lower raceway of the outer rail. A portion of the hook may normally contact an intrusion in the lower raceway of the outer rail, preventing further forward motion of the intermediate rail with respect to the outer rail. In some embodiments, the hook block may be rotated, for example by lifting a rear of the hook block, such that the hook clears the intrusion, allowing the intermediate rail to be removed from the outer rail.

Figure 2B:
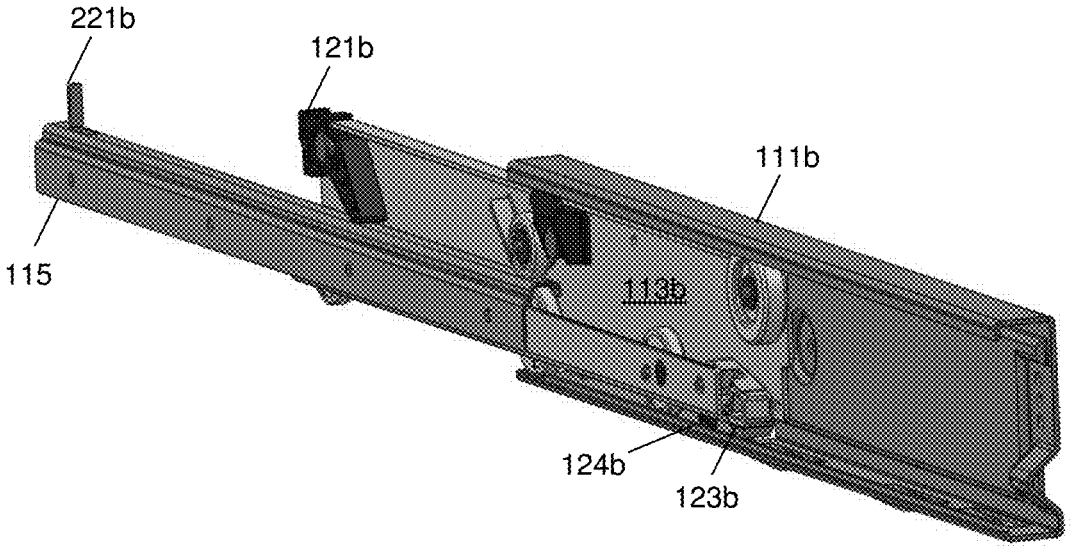
FIG. 2B is a perspective rear inner side view of the further drawer slide of FIG. 1B in an open or extended position.

FIG. 2B is a perspective rear inner side view of the further drawer slide of FIG. 1B in an open or extended position. With the further drawer slide in the extended position, with the inner rail 115, intermediate rail 113*b*, and outer rail 111*b* extended from one another, it may be seen that the further drawer slide generally includes the elements of the drawer slide of FIG. 2B, except as otherwise noted. For purposes of FIG. 2B, it may be seen that an in-stop 221*b* of the inner rail 115 is of a greater length. This provides for increased height so as to be able to contact the forward edge of the disconnect lever, which is at a greater distance from the upper raceway of the inner rail. In addition, a rear hook block 123*b* of the intermediate rail includes a mid-length vertical slot for placement of a spring to bias the hook end of the rear hook block downwards. Further, a portion of a guide block 124*b* is shown as extending from the intermediate rail and into the lower raceway of the outer rail, about a forward edge of the rear hook block. The guide block serves, in some embodiments, in reducing lateral movement of the lower rear portion of the intermediate rail away from the web of the outer rail, through contact between the guide block and an upturned edge of the lower raceway of the outer rail.

Figure 3A:
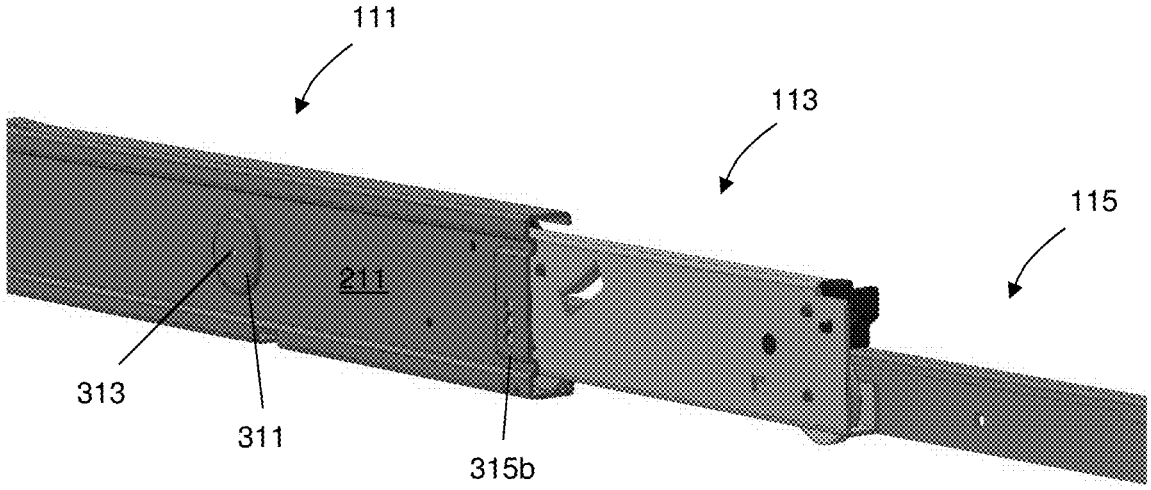
FIG. 3A is a perspective front outer side view of the drawer slide of FIG. 1A in an open or extended position.

FIG. 3A is a perspective front outer side view of the drawer slide of FIG. 1A in an open or extended position. As with FIG. 2A, in the open position, the intermediate rail 113 is longitudinally extended from the outer rail 111, and the inner rail 115 is longitudinally extended from the intermediate rail.

FIG. 3A also shows a plate 313 offset from the web 211 of the outer rail. The plate is offset from the web in a direction away from the intermediate rail, and towards a cabinet sidewall, if the outer rail is mounted to the cabinet sidewall. The plate includes an aperture through the plate, and the web, allowing for passage of mounting hardware, for example a screw or the like. In the embodiment of FIG. 3A, the offset plate is circular in shape, and at about a mid-point of the longitudinal length of the outer rail, with the aperture for mounting hardware in a middle of the plate.

Corresponding offset bars are at a front and a rear of the web of the outer rail, with a front offset bar 315*b* visible in FIG. 3A (with a rear of the outer rail not shown in FIG. 3A). The offset bars include openings though the bars, and the web, allowing for passage of mounting hardware. The offset bars are offset from the web in the same direction and, in many embodiments, a same distance as the offset plate.

The offset plate and the offset bars allow for mounting of the outer rail to a cabinet sidewall, or in some embodiments cabinet frame for example using only the offset bars. The offset plate and offset bars, being offset from the web of the outer rail, also provide clearance room for heads of the mounting hardware, such that the mounting hardware is not in a travel path of the web of the intermediate rail.

Figure 3B:
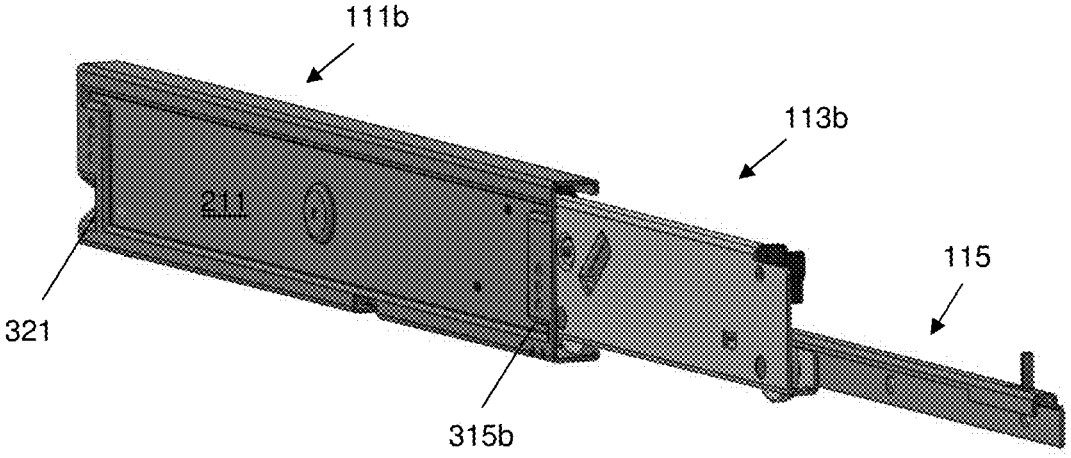
FIG. 3B is a perspective front outer side view of the further drawer slide of FIG. 1B in an open or extended position.

FIG. 3B is a perspective front outer side view of the further drawer slide of FIG. 1B in an open or extended position. Similar to FIG. 3A, FIG. 3B shows the further drawer slide with the inner rail 115 extended from the intermediate rail 113*b*, and the intermediate rail extended from the outer rail 111*b*. The discussion of the offset plate and offset bars of the outer rail of FIG. 3A also applies to the outer rail of FIG. 3B. In the embodiment of FIG. 3B it may be seen that the offset bars include offset portions that extend to a forward edge and a rear edge of the outer rail. In addition, the outer rail as a whole includes offset portions 321 that circumferentially bound a side of the web 211 to be mounted to a cabinet. In the embodiment of FIG. 3B, the offset portions circumferentially bounding the side of the web include the offset bars, though in various embodiments the offset portions may be separate from the offset bars. The offset portions circumferentially bounding the web of the outer rail may be useful, for example, in avoiding or reducing extent of debris that may become lodged between the web of the outer rail and a cabinet side wall.

Figure 4A:
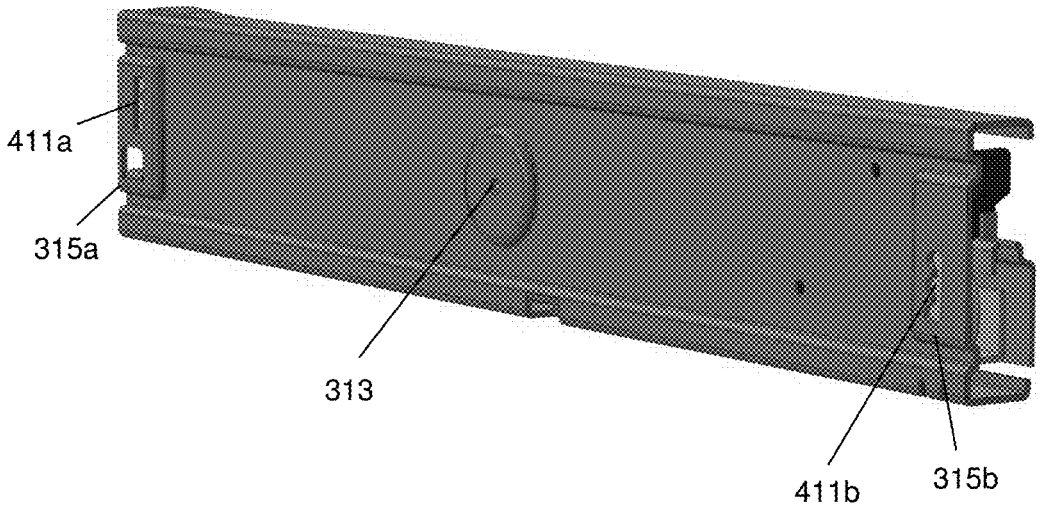
FIG. 4A is a perspective front outer side view of the drawer slide of FIG. 1A in a closed or unextended position.

FIG. 4A is a perspective front outer side view of the drawer slide of FIG. 1A in a closed or unextended position. In FIG. 4A, both the rear offset bar 315*a* and the front offset bar 315*b* of the outer rail are visible. The offset bars each include an opening 411*a,b*, with each opening having a plurality of vertically separated support surfaces. The openings may be formed in a variety of shapes to form the support surfaces. In the illustrated embodiment the support surfaces are provided by a scalloped edge of the openings, with each opening have a vertical edge with 2 protruding scallops providing for 3 support surfaces (which may also be viewed as 3 scalloped portions removed providing for 3 support surfaces).

For the embodiment of FIG. 4A, the offset bars are positioned at different vertical heights on the longitudinal web of the outer rail. In some embodiments, and as illustrated in FIG. 4A, a lowest support surface of the rear offset bar and a highest vertical support surface of the front offset bar are the same distance from a lower edge of the outer rail. A next lowest support surface of the rear offset bar, however, is a greater distance from the lower edge of the outer rail than any of the support surfaces of the front offset bar. Installation of mounting hardware at the same vertical height with respect to the cabinet, therefore, allows for mounting of the outer rail (and hence the drawer slide) either with the drawer slide horizontally level or somewhat tilted such that gravity naturally biases the drawer slide to the closed position. Such a configuration may be useful as installers may find it more convenient to determine placement of mounting hardware using levels, and installation of the mounting hardware at the same vertical level in the cabinet may provide for increased ease of installation. For example, with mounting hardware installed at the same vertical level, use of the lowest support surface of the rear offset bar and the highest support surface of the front offset bar results in the drawer slide being installed level with respect to a ground plane. To the contrary, with mounting hardware also installed at the same vertical level, use of another support surface of the rear offset bar, for example the highest support surface, and another support surface of the front offset bar, for example the lowest support surface, results in the drawer slide being tilted such that the drawer slide is naturally urged to the closed or retracted position. Such biasing of the drawer slide may be desired, for example to increase ease of closing a drawer or to assist in preventing unwanted opening of the drawer.

In some embodiments, the outer rail may first be mounted to a cabinet side wall using the aperture of the offset plate in the center of the web. Thereafter, mounting hardware may be attached through the openings in the rear offset bar and the front offset bar. In doing so, an installer may make use of a level horizontal line or portions thereof, which may be scribed or drawn on cabinet side wall, to adjust tilt of the outer rail.

Figure 4B:
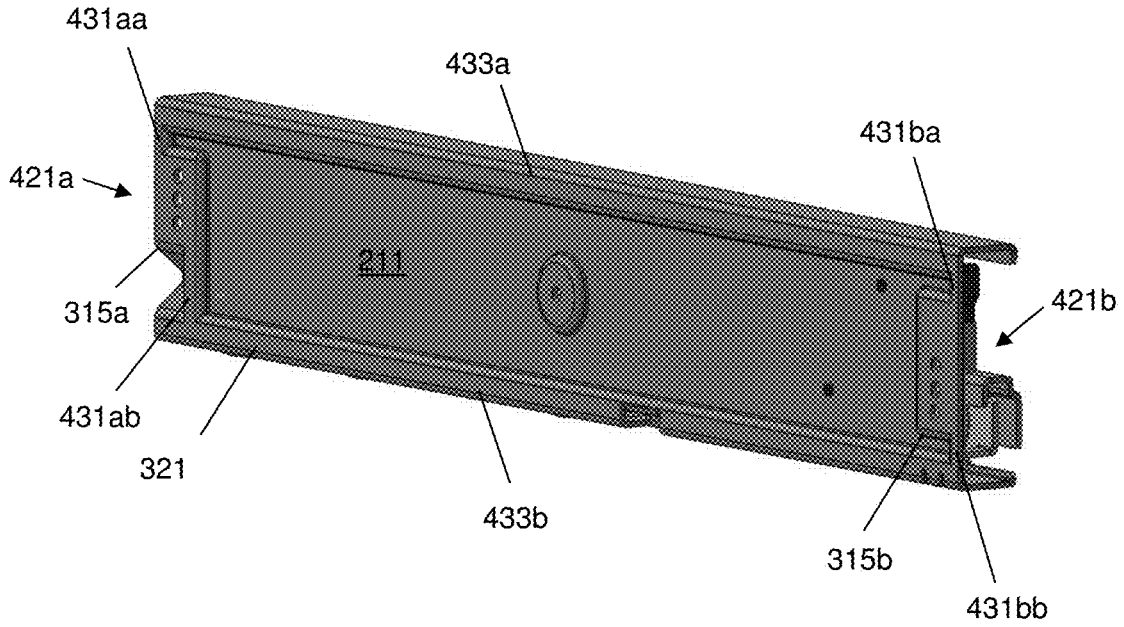
FIG. 4B is a perspective front outer side view of the further drawer slide of FIG. 1B in a closed or unextended position.

FIG. 4B is a perspective front outer side view of the further drawer slide of FIG. 1B in a closed or unextended position. In FIG. 4B, both the rear offset bar 315*a* and the front offset bar 315*b* of the outer rail are visible. While the offset bars of FIG. 4A each included an opening with scalloped edges, the offset bars of FIG. 4B instead each include a plurality of mounting holes 421*a,b* for use in mounting the outer rail to a cabinet. In the embodiment of FIG. 4B the mounting holes of an offset bar are each at different distances from the lower edge of the outer rail. In some embodiments, including that of FIG. 4B, the mounting holes of each offset bar are arranged in a linear fashion. Similar to FIG. 4B, a lowest mounting hole of the rear offset bar and the highest mounting hole of the front offset bar are at a same distance from the lower edge of the outer rail. The other mounting holes of the rear offset bar progress upward along the outer rail, and the other mounting holes of the front offset bar progress downward along the outer rail. As with the outer rail of FIG. 4A, the outer rail of FIG. 4B may be conveniently mounted with varying degrees of declination from front to rear.

FIG. 4B also shows the offset portions 321 circumferentially bounding the web 211 of the outer rail. In FIG. 4B, the offset portions include the offset bars 315*a,b*, part of structures 433*a,b* forming upper and lower raceways of the outer rail, and connecting portions 431*aa-bb* connecting the offset bars and the parts of the structures forming the raceways. A forward edge of the web is bounded by a forward one of the offset bars 315*b*, a forward edge of the part of the structure 433*a* forming the upper raceway, a forward edge of the part of the structure 433*b* forming the lower raceway, and a forward upper connecting portion 431*ba* connecting the offset bar 315 and the part of the structure 433*a* and a forward lower connecting portion 431*bb* connecting the offset bar 315 and the part of the structure 433*b*. Top and bottom edges of the web are bounded by parts of the structures 433*a* and 433*b*, respectively. A rearward edge of the web is bounded by a rearward one of the offset bars 315*a*, a rearward edge of the part of the structure 433*a* forming the upper raceway, a rearward edge of the part of the structure 433*b* forming the lower raceway, and a rearward upper connecting portion 431*aa* connecting the offset bar 315 and the part of the structure 433*a* and a rearward lower connecting portion 43 lab connecting the offset bar 315 and the part of the structure 433*b*.

Figure 5A:
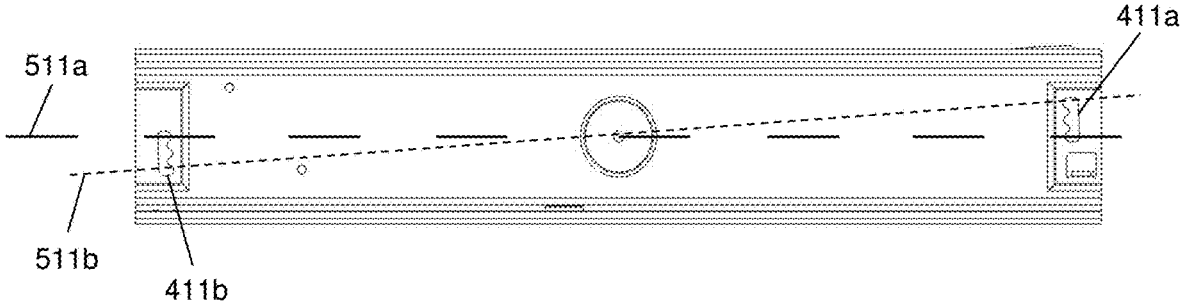
FIG. 5A is an inner side view of the outer rail of the drawer slide of FIG. 1A, in accordance with aspects of the invention.

FIG. 5A is an inner side view of the outer rail of the drawer slide of FIG. 1A, in accordance with aspects of the invention. As FIG. 5A shows the inner side view, the relative position on the page of the rear offset bar (and its opening 411*a*) and the front offset bar (and its opening 411*b*) are shown as reversed as compared to FIG. 4A.

FIG. 5A also show a dashed line 511*a* extending horizontally through an uppermost scallop of the opening 411*b* of the front offset bar, through the aperture of the central offset plate, and through a lowermost scallop of the opening 411*a* of the rear offset bar. In some embodiments such a line may be marked on a cabinet side wall, to allow for increased ease in positioning the outer rail during a mounting process. In some embodiments a level may be used to level the outer rail horizontally, with the outer rail positioned against the cabinet side wall, and markings may be made on the cabinet side wall to indicate positions of the uppermost scallop, the aperture, and the lowermost scallop. In some embodiments the outer rail may be mounted to the cabinet side wall, temporarily in some embodiments, using the aperture of the central offset plate. A level may then be used to horizontally level the outer rail longitudinally, and mark positions of the uppermost scallop and the lowermost scallop. If a horizontally level drawer slide is desired, the outer rail may be mounted to the cabinet side wall using the uppermost front scallop and lowermost rear scallop for placement of the mounting hardware. If a slightly tilted drawer slide is desired, with the rear slightly lower than the front, scallops other than the uppermost front scallop and/or lowermost rear scallop may be used at the marked positions for mounting the drawer slide. For example, a maximum tilt may be obtained using a lowermost front scallop and an uppermost rear scallop. In FIG. 5A, an angular difference in tilt between use of the uppermost front scallop and the lowermost rear scallop compared with use of the lowermost front scallop and the uppermost rear scallop may be seen through comparison of the dashed line 511*a* with a dashed line 511*b*.

Figure 5B:
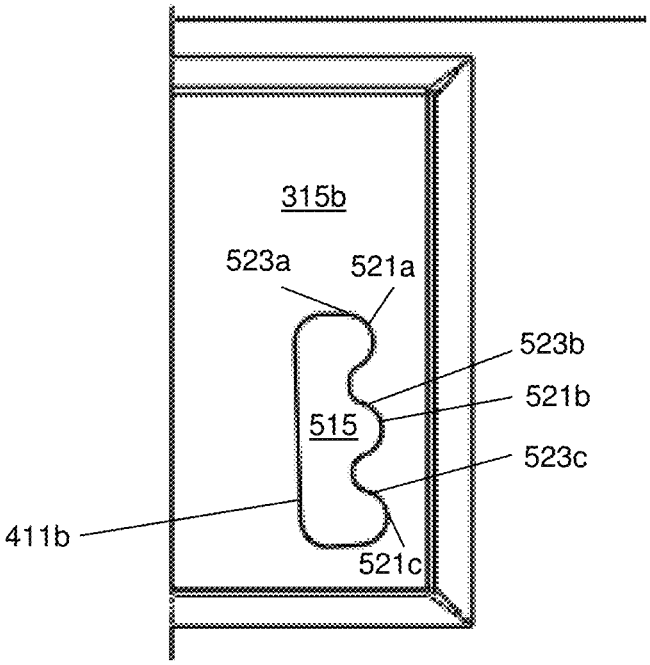
FIG. 5B is a close-up view of a portion of the outer rail of FIG. 5A, with the portion including a front opening for receiving a fastener to support the outer rail with respect to a cabinet.

FIG. 5B is a close-up view of a portion of the outer rail of FIG. 5A, with the portion including the front opening for receiving a fastener to support the outer rail with respect to a cabinet. FIG. 5B shows the front offset bar 315*b*. The front offset bar is shown as generally rectangular in shape, with a height greater than a width, although other shapes may be used on various embodiments. The opening 411*b* is within the bounds of the offset bar. The opening is generally rectangular, with support surfaces along one edge, a generally vertical edge in the embodiment of FIG. 5B. The support surfaces are vertically separated from one another. The support surfaces allow for support of the outer rail when mounted to a cabinet, using for example mounting hardware. Different ones of the support surfaces provide for mounting of the front of the outer rail at different levels. In conjunction with another outer rail opening or aperture, which may be similar to or the same as the front opening in some embodiments, the different support surfaces allow for different horizontal tilts, even when a same location on a cabinet sidewall is used for mounting of the outer rail.

In FIG. 5B, the edge with the support surfaces is in the form of a scalloped edge. The scallops include an uppermost scallop 521*a* of removed material of the offset bar, about an upper edge 523*a* of the opening. The removed material allows for passage of at least part of a body of a screw, or other mounting hardware, with the upper edge providing a support surface for mounting of the outer rail. A similar middle scallop 521*b* of removed material is at a level lower than the uppermost scallop. An upper edge 523*b* of the middle scallop provides another support surface for mounting of the outer rail. A lowermost scallop 521*c* of removed material, also similar to the other two scallops, is at a level lower than the middle scallop. An upper edge 523*c* of the lowermost scallop provides yet another support surface for mounting of the outer rail.

Figure 5C:
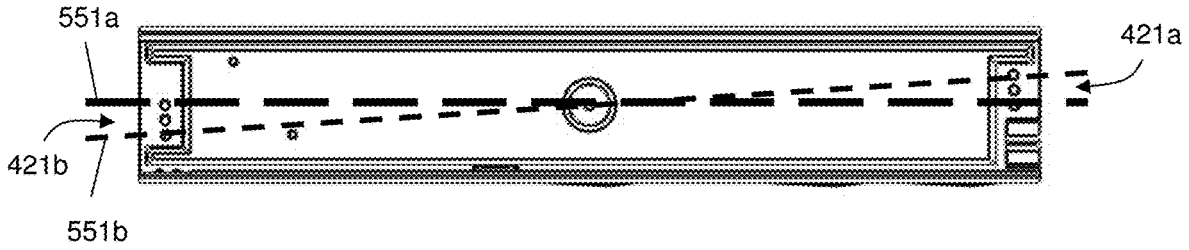
FIG. 5C is an inner side view of the outer rail of the further drawer slide of FIG. 1B, in accordance with aspects of the invention.

FIG. 5C is an inner side view of the outer rail of the further drawer slide of FIG. 1B, in accordance with aspects of the invention. As with FIG. 5A, FIG. 5C shows the inner side view, with the relative position on the page of the rear offset bar (and its mounting holes 421*a*) and the front offset bar (and its mounting holes 421*b*) shown as reversed as compared to FIG. 4B.

Also as with FIG. 5A, FIG. 5C shows a dashed line 551*a* extending horizontally through an uppermost mounting hole of the mounting holes 421*b* of the front offset bar, through the aperture of the central offset plate, and through a lowermost mounting hole of the mounting holes 421*a* of the rear offset bar. In some embodiments such a line may be marked on a cabinet side wall, to allow for increased ease in positioning the outer rail during a mounting process. An angular difference in tilt between use of the uppermost front mounting hole and the lowermost rear mounting hole compared with use of the lowermost front mounting hole and the uppermost rear mounting hole may be seen through comparison of the dashed line 551*a* with a dashed line 551*b*.

Figure 5D:
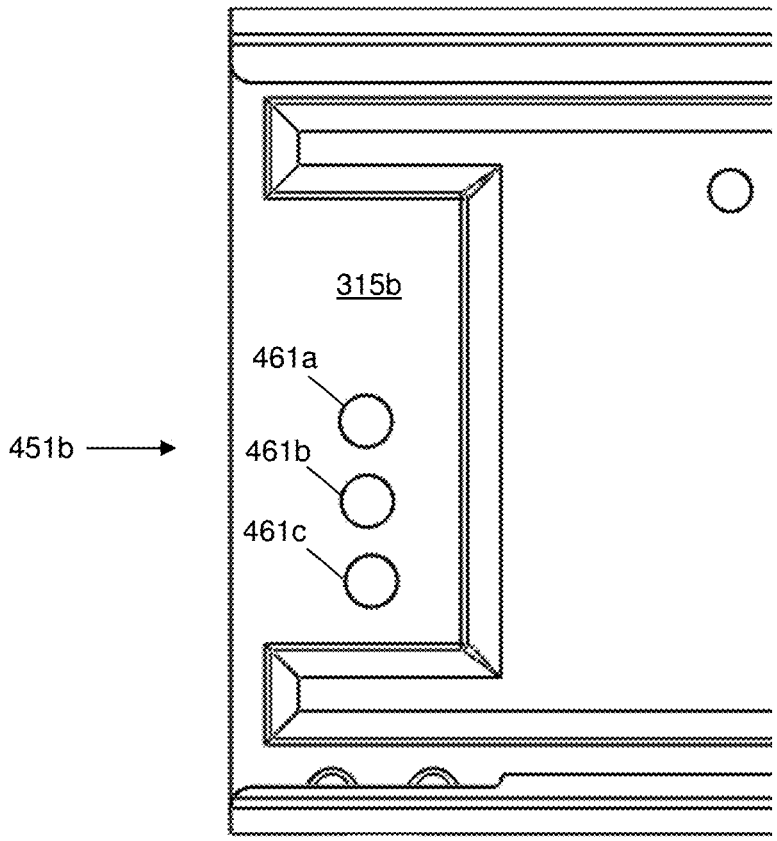
FIG. 5D is a close-up view of a portion of the outer rail of FIG. 5B, with the portion including mounting holes for receiving a fastener to support the outer rail with respect to a cabinet.

FIG. 5D is a close-up view of a portion of the outer rail of FIG. 5C, with the portion including mounting holes for receiving a fastener to support the outer rail with respect to a cabinet. FIG. 5D shows the front offset bar 315*b*. The front offset bar is shown as generally rectangular in shape, with a height greater than a width, although other shapes may be used on various embodiments. The mounting holes are within the bounds of the offset bar. The mounting holes 461*a-c* are vertically separated from one another. The embodiment of FIG. 5D includes three mounting holes, in some embodiments a greater number of mounting holes may be used for an offset bar, each vertically separated from the other mounting holes of the offset bar. The mounting holes allow for support of the outer rail when mounted to a cabinet, using for example mounting hardware.

Figure 6A:
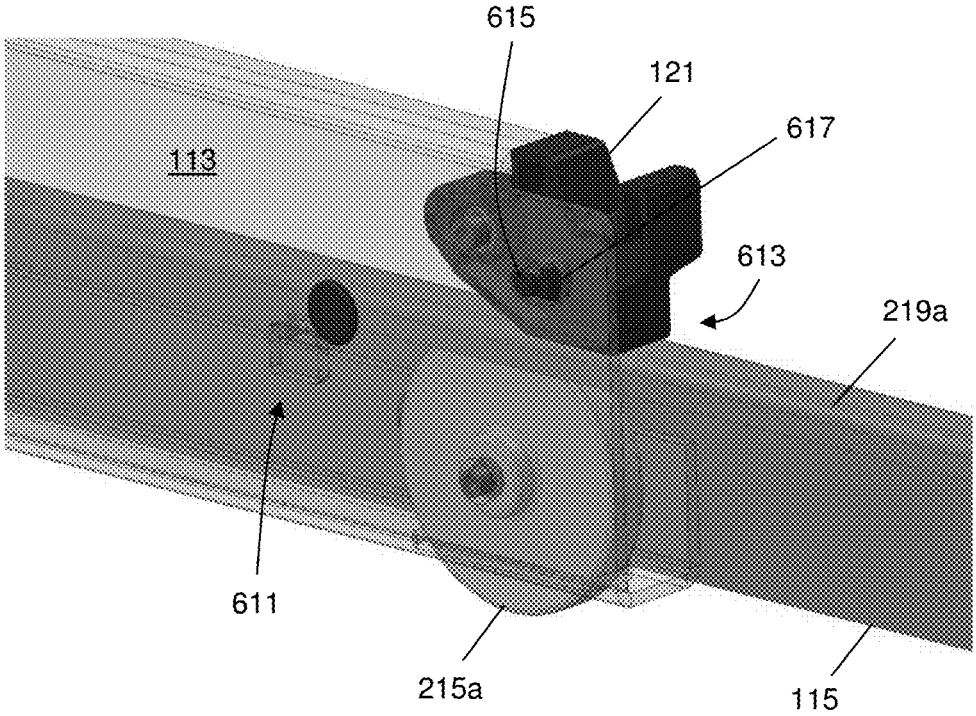
FIG. 6A is a partially transparent view of portions of an inner rail and an intermediate rail of the drawer slide of FIG. 1A, and a disconnect lever for constraining in-plane movement of the inner rail, in accordance with aspects of the invention.

FIG. 6A is a partially transparent view of portions of the inner rail and the intermediate rail of the drawer slide of FIG. 1A, and a disconnect lever for constraining in-plane movement of the inner rail, in accordance with aspects of the invention. In FIG. 6A, the intermediate rail 113 is shown partially ghosted (transparent). The inner rail 115 is shown at least partially extended from the intermediate rail, with an upper raceway 219*a* of the inner rail riding on the forward roller 215*a* of the intermediate rail. The disconnect lever 121 has a lower surface 613 in contact with an upper surface of the upper raceway of the inner rail, although in various embodiments the lower surface of the disconnect lever may be just above the upper surface of the raceway. With the inner rail extending from the intermediate rail in what may be considered a horizontal direction, the disconnect lever therefore prevents upward vertical motion of the upper raceway, and hence the inner rail, at the position of the disconnect lever. More generally, the disconnect lever may be considered to restrict motion of the inner rail at the location of the disconnect lever in an upward latitudinal direction of the plane of the web of the inner rail. In addition, as may be seen in FIGS. 1 and 2, the mid-rail roller 119 of the intermediate rail also serves to restrict motion of the inner rail in the upward latitudinal direction of the plane of the web of the inner rail, while the rollers 215*a-c* serve to restrict motion of the inner rail in a downward latitudinal direction of the plane of the web of the inner rail.

Figure 7:
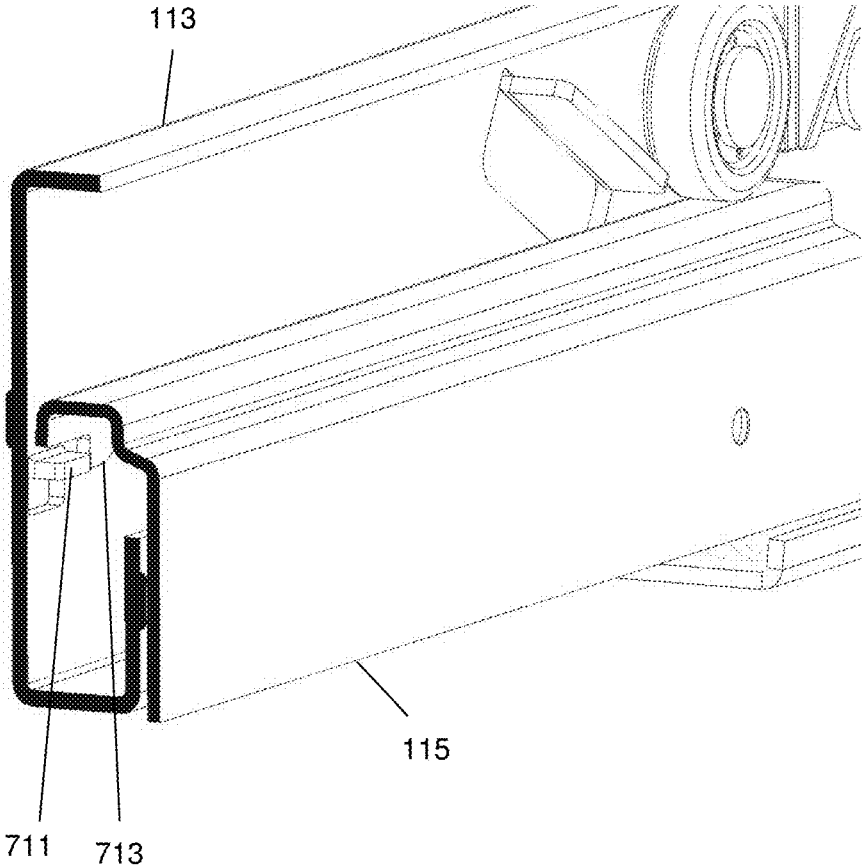
FIG. 7 is a cut-away perspective view of the inner rail and intermediate rail of FIG. 6A, showing an example of a catch and stop tab for stopping forward movement of the inner rail with respect to the intermediate rail, in accordance with aspects of the invention.

Also visible in FIG. 6A is a punched-in portion 611 of the intermediate rail. The punched in portion is used to form a stop tab on the intermediate rail, as can be more fully seen in FIG. 7. FIG. 7 is a cut-away perspective view of the inner rail and intermediate rail of FIG. 6A, showing an example of a catch and stop tab for stopping forward movement of the inner rail with respect to the intermediate rail, in accordance with aspects of the invention. In FIG. 7, the stop tab 711 of the intermediate rail extends towards the web of the inner rail, and is generally just below an edge surface upper raceway of the inner rail. The inner rail, however, also includes a catch 713 formed in that edge surface, with the stop tab being in the normal travel path of the catch as the inner rail extends from the intermediate rail. The stop tab therefore provides a stop for normal extension of the inner rail from the intermediate rail.

Figure 6B:
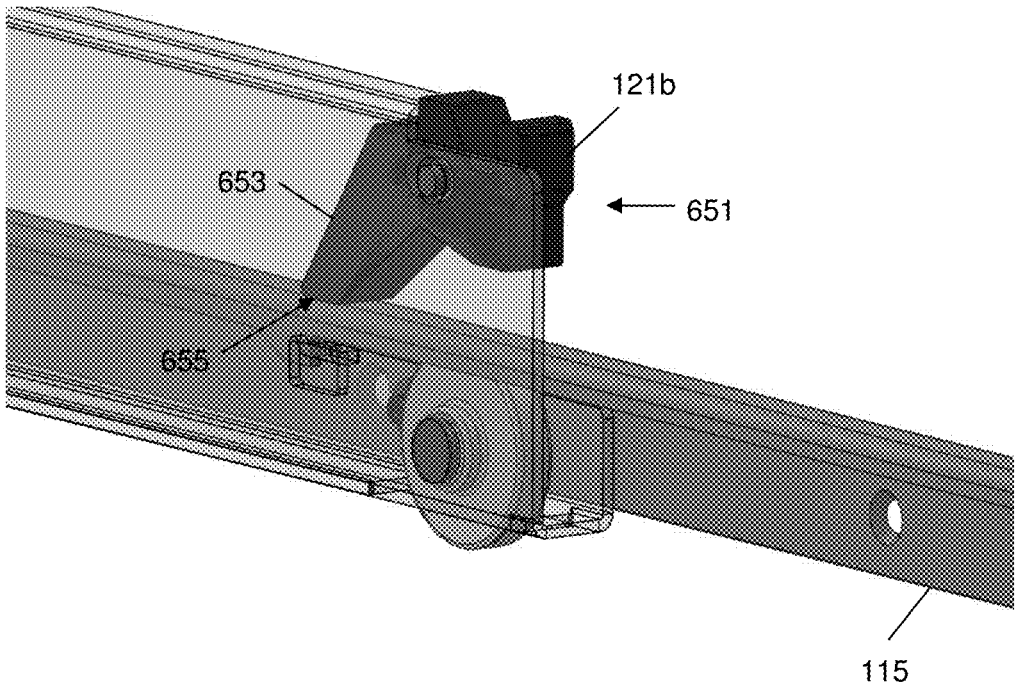
FIG. 6B is a partially transparent view of portions of an inner rail and an intermediate rail of the further drawer slide of FIG. 1B, and a disconnect lever for constraining in-plane movement of the inner rail, in accordance with aspects of the invention.

FIG. 6B is a partially transparent view of portions of the inner rail and the intermediate rail of the further drawer slide of FIG. 1B, and a disconnect lever for constraining in-plane movement of the inner rail, in accordance with aspects of the invention. The view in FIG. 6B mirrors that of FIG. 6A, but for the further drawer slide of FIG. 1B instead of the drawer slide of FIG. 1A. The presence of components and operation of the further drawer slide is as discussed with respect FIG. 6A and FIG. 7. Notably, however, the disconnect lever 121*b* of the further drawer slide of FIGS. 1B and 6B is differently shaped than the disconnect lever 121 of the drawer slide of FIGS. 1A and 6A.

The disconnect lever 121*b* of FIG. 6B includes a body 651 pivotably coupled to the web of the intermediate rail. Normally, pivoting of the body is constrained in one direction by a forward edge of the upper raceway of the outer rail, and constrained in an opposing direction by upper raceway itself. A tail 653 extends rearward and downward, with an end 655 of the tail on, or close to in some embodiments, an upper surface of the inner rail. The disconnect lever therefore prevents upward vertical motion of the upper raceway, and hence the inner rail, at the position of the end of the tail of the disconnect lever. As the further drawer slide of FIG. 6B includes the stop tab and catch as discussed with respect to FIG. 7, withdrawal of the inner rail from the intermediate rail is normally prevented.

Figure 8A:
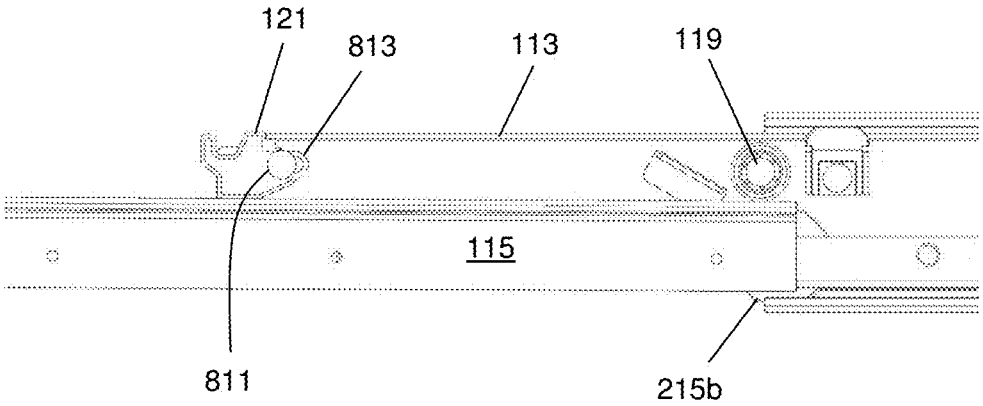
FIG. 8A is an inner side view of the drawer slide of FIG. 1A, with the disconnect lever constraining upward vertical movement of the inner rail with respect to the intermediate rail, such that the catch may not pass by the stop tab.

FIG. 8A is an inner side view of the drawer slide of FIG. 1A, with the disconnect lever constraining upward vertical movement of the inner rail with respect to the intermediate rail, such that the catch may not pass by the stop tab. In FIG. 8A, the inner rail 115 is in a fully extended position with respect to the intermediate rail 113. The disconnect lever 121 is mounted to the web of the intermediate rail about its front end, with the disconnect lever shown as sitting on the inner rail in FIG. 8A. In some embodiments the disconnect lever may be close to the inner rail, but not normally in actual contact with the inner rail. Also, in the embodiment of FIG. 8A the disconnect lever extends forward of the front of the intermediate rail, although the disconnect lever may be otherwise positioned with respect to the intermediate rail.

With the disconnect lever positioned on the inner rail, upward vertical motion of the inner rail at the position of the disconnect lever is generally prevented by the disconnect lever. With upward vertical motion of the inner rail also generally prevented by the mid-rail roller 119, upward motion of the inner rail as a whole is generally prevented. Rotational upward motion of a forward end of the inner rail is also generally prevented by the disconnect lever and the middle roller 215*b* of the intermediate rail.

The disconnect lever is shown in FIG. 8A as mounted to the intermediate rail by a headed pin 811, which may be in the form of a rivet, for example shoulder rivet. In FIG. 8A the pin is in a forward portion of the aperture, and the disconnect lever is in a locking position. The pin and an aperture 813 of the disconnect lever through which the pin passes nominally allow for some translational and rotational movement of the disconnect lever, although in some embodiments only translational or rotational movement may be so allowed. For the embodiment of FIG. 8A, translational movement of the disconnect lever with respect to the intermediate rail is restricted to horizontal movement in the directions of extension and retraction of the drawer slide. This restriction is due both to a shape of the disconnect lever aperture, and also due to a shape of a cutout 617 in the intermediate rail in which a pin 615 of the disconnect lever extends, as may be seen in FIG. 6A. As may be seen in FIG. 6A, the cutout has a somewhat reverse L-shape, allowing for pulling of the disconnect lever forward of the intermediate rail. Similarly, rotational movement of the disconnect lever is restricted in one direction by the inner rail, and in the other rotational direction by both the forward edge of the intermediate rail, which blocks rotation of the disconnect lever, and the shape of the cutout of the intermediate rail. With forward translational extension of the disconnect lever, the pin is placed in a rear portion of the aperture and some upward motion of a front of the disconnect lever is allowed by the cutout, as well as by the forward edge of the intermediate rail.

Figure 9A:
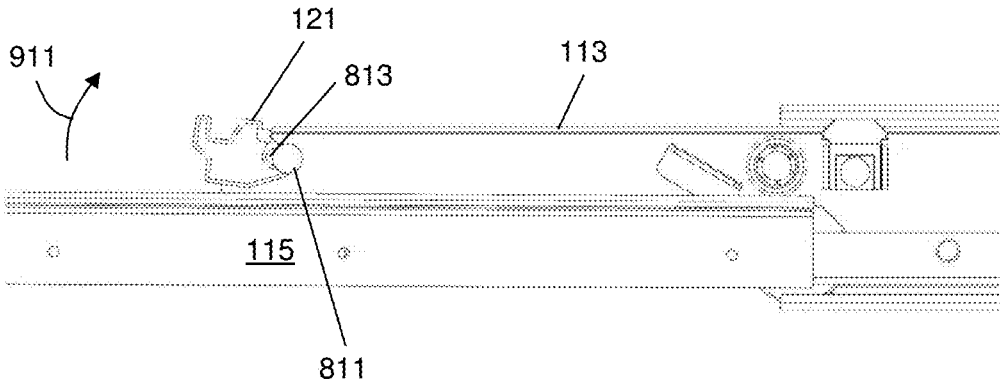
FIG. 9A is a further inner side view of the drawer slide of FIG. 1A, with the disconnect lever moved to a position such that the catch may pass by the stop tab.

FIG. 9A is a further inner side view of the drawer slide of FIG. 1A, with the disconnect lever moved to a position such that the catch may pass by the stop tab. As may be seen in FIG. 9A, the disconnect lever 121 has been moved forward from the forward edge of the intermediate rail 113. In FIG. 9A the pin 811 is in the rear portion of the aperture 813 of the disconnect lever, as compared to the forward portion as indicated in FIG. 8A. The forward portion of the disconnect lever has also been rotated upward, displacing the disconnect lever from the inner rail 115. With the disconnect lever so positioned, a forward end of the inner rail may be rotated upward, for example as indicated by arrow 911. Rotating the forward end of the inner rail upward allows the catch 713 (shown in FIG. 7) of the inner rail to bypass the stop tab 711 (also shown in FIG. 7) of the intermediate rail, so that the inner rail may be withdrawn from the intermediate rail. In addition, closing of the drawer slide, with the disconnect lever positioned as in FIG. 9A, results in the in-stop 221 (shown in FIG. 2A) contacting the forward edge of the disconnect lever, rotating the forward portion of the disconnect lever downward and translating the disconnect lever rearward such that the pin 811 is positioned in the forward portion of the aperture 813. The in-stop therefore causes the disconnect lever to be placed in a locking position on closing of the drawer slide.

Figure 8B:
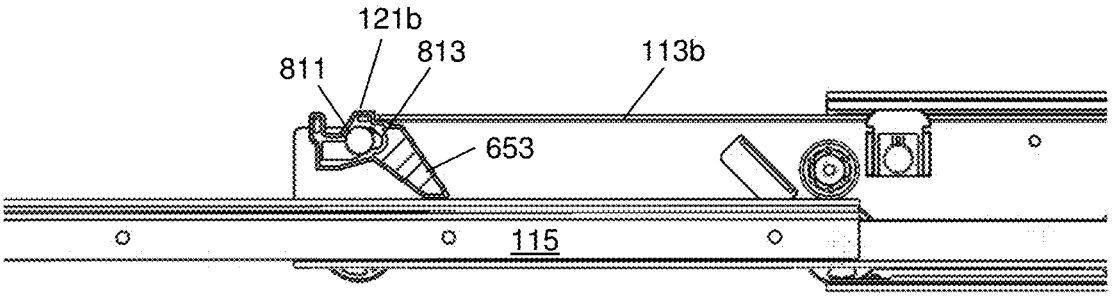
FIG. 8B is an inner side view of the further drawer slide of FIG. 1B, with the disconnect lever constraining upward vertical movement of the inner rail with respect to the intermediate rail, such that the catch may not pass by the stop tab.

FIG. 8B is an inner side view of the further drawer slide of FIG. 1B, with the disconnect lever constraining upward vertical movement of the inner rail with respect to the intermediate rail, such that the catch may not pass by the stop tab. As with the embodiment of FIG. 8A, in FIG. 8B the inner rail 115 is in a fully extended position with respect to the intermediate rail 113*b*, and the disconnect lever 121 is mounted to the web of the intermediate rail about its front end. The disconnect lever of FIG. 8B is mounted to the intermediate rail by a headed pin 811. The pin and an aperture 813 of the disconnect lever through which the pin passes nominally allow for some translational and rotational movement of the disconnect lever. In FIG. 8B, the disconnect lever is in a locking position, with the end of the tail 653 of the disconnect lever shown as sitting on the inner rail and the pin in a forward portion of the aperture.

Figure 9B:
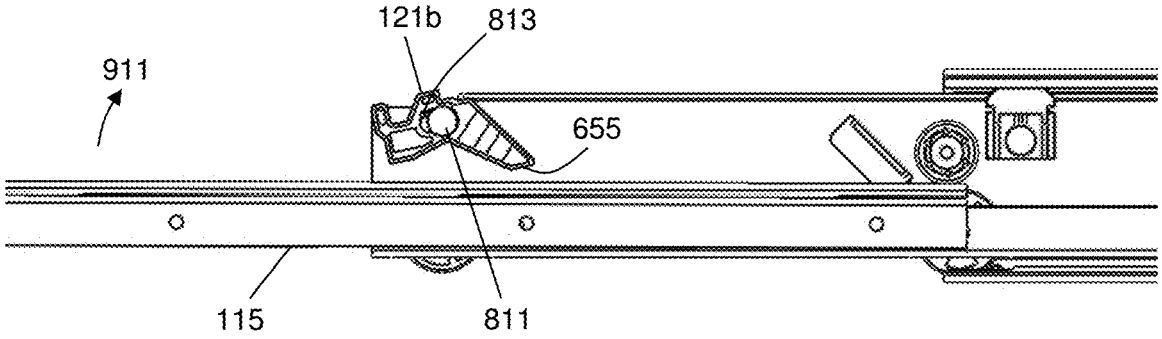
FIG. 9B is a further inner side view of the further drawer slide of FIG. 1B, with the disconnect lever moved to a position such that the catch may pass by the stop tab.

FIG. 9B is a further inner side view of the further drawer slide of FIG. 1B, with the disconnect lever moved to a position such that the catch may pass by the stop tab. In FIG. 9A, the disconnect lever 121*b* has been moved forward from the forward edge of the intermediate rail 113*b*, and the pin 811 is in a rear portion of the aperture 813 of the disconnect lever. The forward portion of the disconnect lever has also been rotated upward, displacing the end 655 of the tail of the disconnect lever from the inner rail 115. With the disconnect lever so positioned, a forward end of the inner rail may be rotated upward, for example as indicated by arrow 911. Rotating the forward end of the inner rail upward allows the catch 713 (shown in FIG. 7) of the inner rail to bypass the stop tab 711 (also shown in FIG. 7) of the intermediate rail, so that the inner rail may be withdrawn from the intermediate rail. In addition, closing of the drawer slide, with the disconnect lever positioned as in FIG. 9A, results in the in-stop 221 (shown in FIG. 2A) contacting the forward edge of the disconnect lever, rotating the forward portion of the disconnect lever upward and translating the disconnect lever rearward such that the pin 811 is positioned in the forward portion of the aperture 813. The in-stop therefore causes the disconnect lever to be placed in a locking position on closing of the drawer slide.

Figure 10:
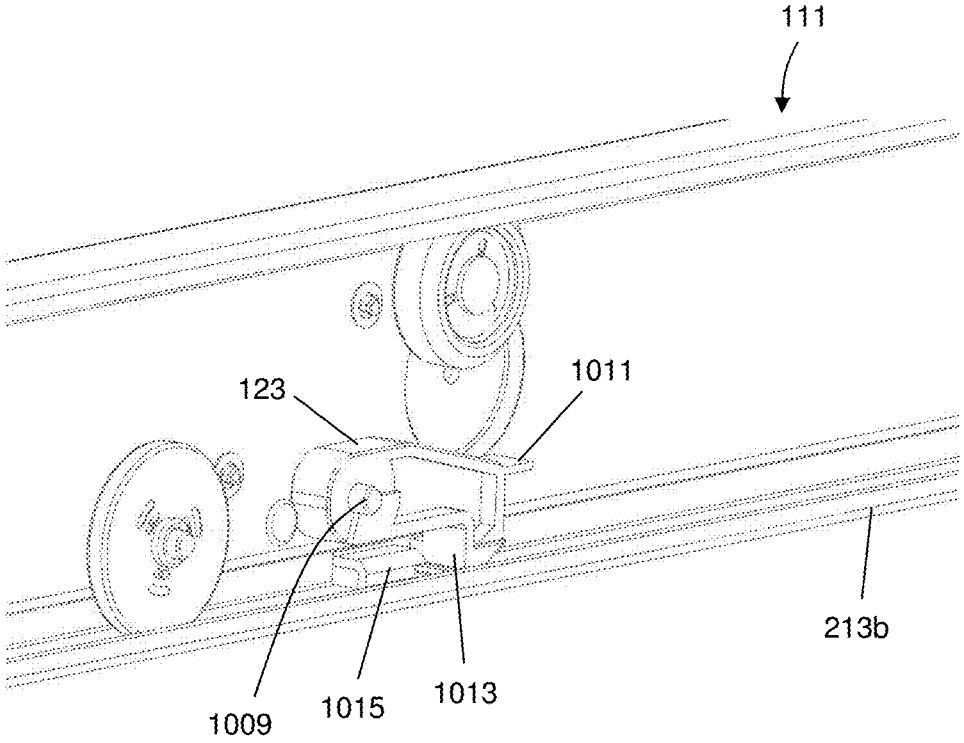
FIG. 10 is a perspective view of an intrusion in a raceway of a first rail and a hook mountable to a second rail, with the intrusion in a travel path of a portion of the hook.

FIG. 10 is a perspective view of an intrusion in a raceway of a first rail and a hook mountable to a second rail, with the intrusion in a travel path of a portion of the hook. In FIG. 10 a hook block 123 is above and partially in a lower raceway of a rail of a drawer slide. The rail may be, for example, the outer rail 111 of the drawer slide of FIG. 1A, and the lower raceway may be the lower raceway 213*b* of the outer rail. The hook block may be mounted to a drawer slide rail, or a part of the rail, for example using a pin 1015 extending out from a lengthwise side of the hook block. In some embodiments the pin may be inserted into an aperture in a flange of an intermediate rail, with the flange parallel to a web of the intermediate rail.

The hook block includes a hook 1013. The hook is about a rear of the hook block, with the pin towards a front of the hook block. A majority of mass of the hook block is on the side of the pin towards the rear of the hook block, the hook is therefore biased by gravity downward into the raceway of the outer rail.

The raceway of the outer rail includes an intrusion 1015. In some embodiments, and as illustrated in FIG. 10, the intrusion may be in the form of a punched-in portion of the raceway, although the intrusion may be otherwise provided in various embodiments. The intrusion is sufficiently dimensioned such that the hook, or a portion of the hook, catches on the intrusion as the rail carrying the hook block moves forward. The intrusion and hook therefore provide a forward stop to extension of the rail carrying the hook block. Raising of the hook allows the hook to clear the intrusion, allowing for removal of the rail carrying the hook block. In some embodiments the hook block has a tab or other structure allowing for increased ease of manually lifting the hook. The embodiment of FIG. 10 includes such a structure, in the form of a tab 1011 extending rearwardly from a top of the hook block.

Figure 11:
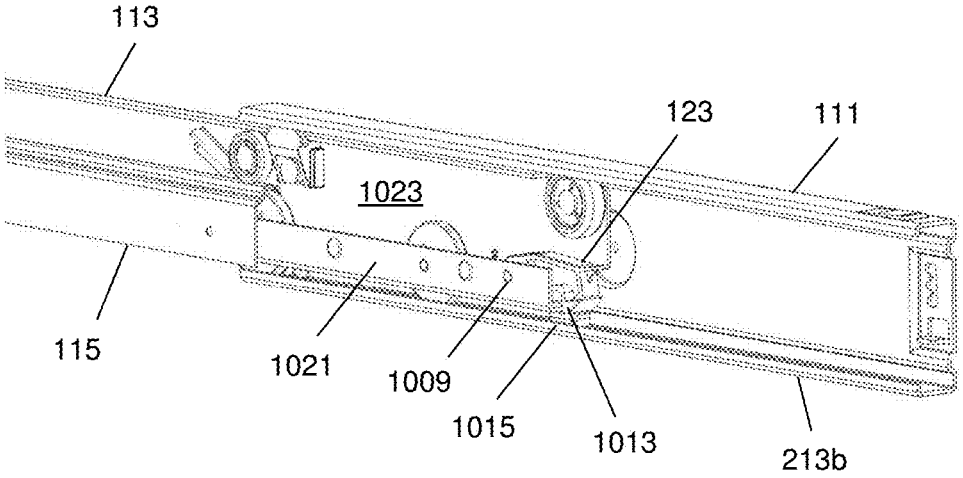
FIG. 11 is a perspective view of the drawer slide of FIG. 1A with the hook of FIG. 10 mounted to an intermediate rail, with the hook moved to a position such that an intrusion in a raceway of the outer rail is not in the travel path of the hook.

FIG. 11 is a perspective view of the drawer slide of FIG. 1A with the hook of FIG. 10 mounted to an intermediate rail, with the hook moved to a position such that an intrusion in a raceway of the outer rail is not in the travel path of the hook. In FIG. 11, the inner rail 115 is fully extended from the intermediate rail. The intermediate rail 113 is also extended from the outer rail 111. The intermediate rail, however, is extended just past a point of full extension from the outer rail, with the intermediate slide able to be withdrawn from the outer rail.

As may be seen in FIG. 11, the hook block 123 is nested between a web 1023 of the intermediate rail and a flange 1021 of the intermediate rail, with the flange parallel to the web. The pin 1009 extends into an aperture of the flange, about a rear of the intermediate rail. The hook 1013 of the hook block is beyond a rearward edge of a lower raceway of the intermediate slide. The hook is normally biased by gravity to ride in the lower raceway 213*b* of the outer rail. The lower raceway of the outer rail includes the intrusion 1015, which normally catches the hook as the intermediate rail is extended, with the intrusion acting as a forward stop for the intermediate rail.

Figure 12A:
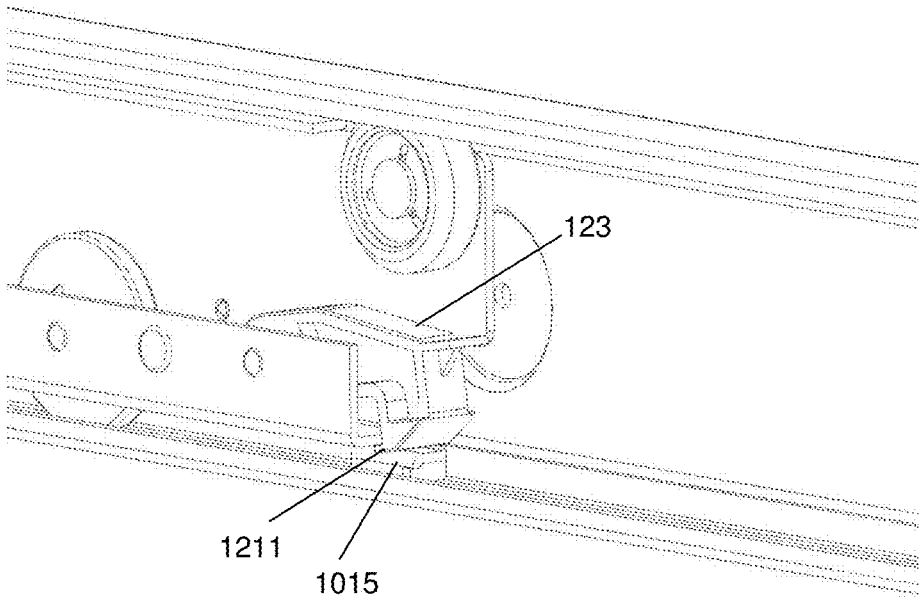
FIG. 12A is a close-up perspective view of the drawer slide with hook of FIG. 11, with the hook moved to a position such that the intrusion is not in the travel path of the hook.

In FIG. 11, however, the hook has been raised to clear the intrusion, with FIG. 11 showing the hook over the intrusion. FIG. 12A is a close-up perspective view of the drawer slide with hook of FIG. 11, with the hook moved to a position such that the intrusion is not in the travel path of the hook. As can be seen in FIG. 12A, an end 1211 of the hook of the hook block 123 is over the intrusion 1015 in the lower raceway of the outer rail. The intrusion therefore no longer blocks the hook, and the intermediate rail may be withdrawn from the outer rail.

Figure 12B:
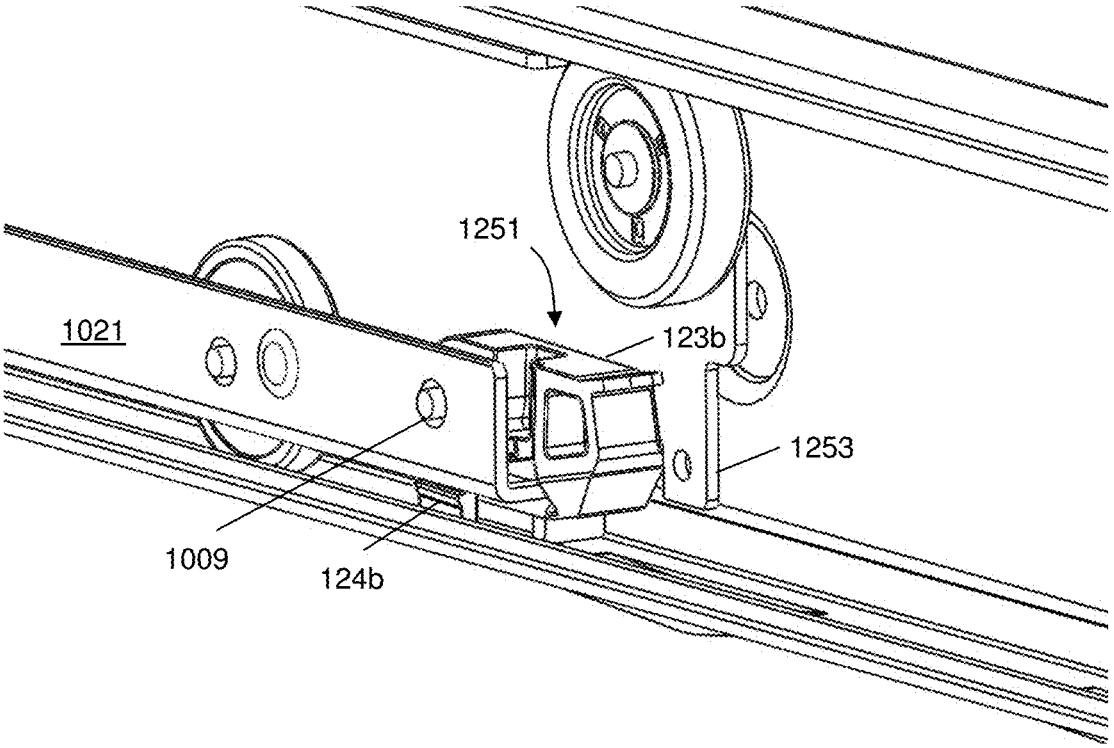
FIG. 12B is a close-up perspective view of the further drawer slide of FIG. 1B, with an alternate hook block mounted to an intermediate rail, with a hook of the hook block moved to a position such that an intrusion in a raceway of the outer rail is not in the travel path of the hook.

FIG. 12B is a close-up perspective view of the further drawer slide of FIG. 1B, with an alternate hook block 123*b* mounted to an intermediate rail, with a hook of the hook block moved to a position such that an intrusion in a raceway of the outer rail is not in the travel path of the hook. The alternative hook block of FIG. 12B is similar to the hook block of, for example, FIG. 12A, and is similarly mounted to a flange of the intermediate rail. The alternative hook block, however, includes a mid-length slot for placement of a spring to bias the hook downwards. The use of the spring may be beneficial, for example, in reducing possibility of inadvertent raising of the hook during operation of the slide. The alternative hook block 123*b* is mounted to the flange 1021 of the intermediate rail by the pin 1009. The guide block 124*b* is also mounted to the flange of the intermediate rail by the pin 1009. As may be seen in FIG. 12B, the guide block includes a portion about, in contact with in some embodiments, an outer edge of the lower raceway of the outer rail. The guide block, which may extend through an aperture of the lower raceway of the intermediate rail, serves to limit lateral movement of the lower rear portion of the intermediate rail.

FIG. 12B also shows the web of the intermediate rail as having a descending leg 1253, with the descending leg rearward of the hook block. The descending leg engages with a rear stop on the outer rail, for example the V-shaped rear stop discussed with respect to FIG. 1B, to provide a limit to rearward movement of the intermediate rail.

Figure 13:
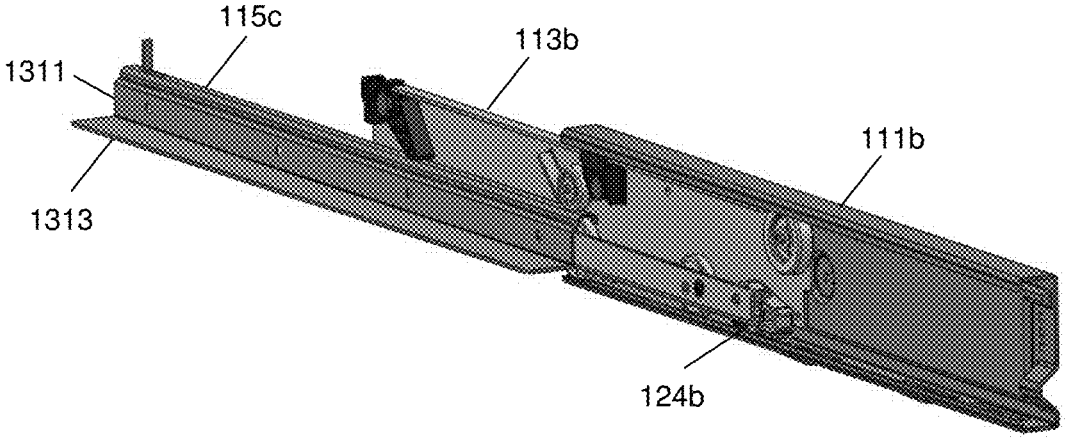
FIG. 13 is a perspective rear inner side view of a yet further drawer slide in accordance with aspects of the invention in an open or extended position.
Figure 14:
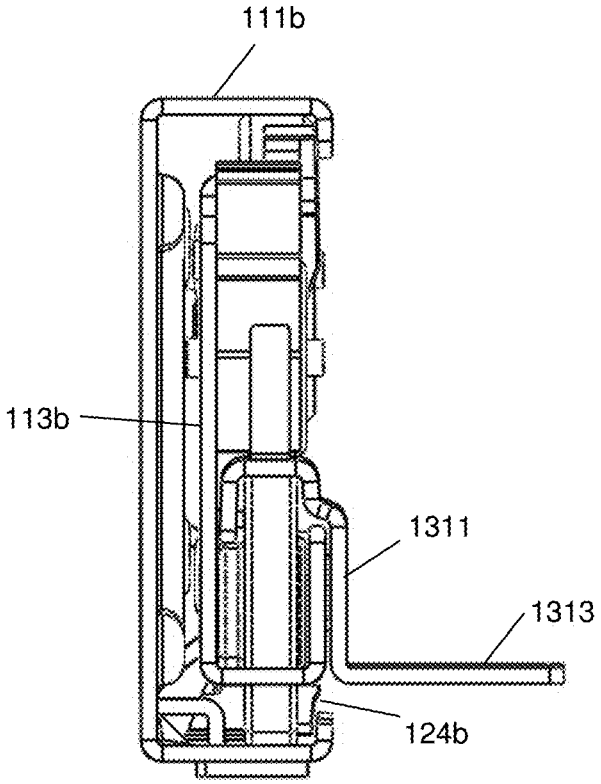
FIG. 14 is a front view of the yet further drawer slide of FIG. 13.

FIG. 13 is a perspective rear inner side view of a yet further drawer slide in accordance with aspects of the invention in a closed or unextended position. The drawer slide of FIG. 13 is similar to the further drawer slide of FIG. 1B, having an outer rail 111*b*, an intermediate rail 113*b*, an inner rail 115*c*, and the associated various components coupled together as previously discussed. The inner rail of the drawer slide of FIG. 13 differs, however, in having an undermount flange extending from a lower edge of a web 1311 of the inner rail. As may be seen in the front view of FIG. 14, the flange extends away from planes defined by the webs of the intermediate rail and/or the outer rail. With the outer rail of the drawer slide mounted to a cabinet sidewall or rail, therefore, the flange may be used for mounting of a drawer to the drawer slide, with the drawer or an edge of the drawer resting on the flange. Also as shown in FIGS. 13 and 14, the guide block 124*b* of the intermediate rail is adjacent an outer edge of the lower raceway of the outer rail.

Although the invention has been discussed with respect to various embodiments, it should be recognized that the invention comprises the novel and non-obvious claims supported by this disclosure.

What is claimed is:

1. A drawer slide comprising:

a plurality of extendably coupled rails, including a first rail for mounting to a cabinet, the first rail including a longitudinal web;

the first rail including a central opening, about a mid-point of the longitudinal rail, for receiving a fastener to support the first rail with respect to the cabinet, a first set of at least three openings about a first end of the longitudinal web for receiving a fastener to support the first rail with respect to the cabinet and a second set of at least three openings about a second end of the longitudinal web for receiving a fastener to support the first rail with respect to the cabinet, each opening of the first set of at least three openings being a different distance from a bottom of the first rail than others of the openings of the first set of three openings, and each opening of the second set of at least three openings being a different distance from a bottom of the first rail than others of the openings of the second set of three openings, the first set of at least three openings and the second set of at least three openings allowing for mounting the rail to the cabinet at a non-zero angle with respect to a base of the cabinet while viewing a potential support position at a zero angle with respect to the base of the cabinet.

2. A drawer slide comprising:

a plurality of extendably coupled rails, including a first rail for mounting to a cabinet;

the first rail including a longitudinal web defining a first plane, with offset portions within the web extending outward from the first plane, the offset portions including a plate about a mid-point of a longitudinal length of the longitudinal web and bars about a front and a rear of the longitudinal web, with the bars offset from the longitudinal web in a same direction and a same distance as the plate, and with the plate and the bars each including at least one aperture for receiving a fastener for fastening the rail to the cabinet.

3. The drawer slide of claim 2, wherein the offset portions extend from the first plane in a direction away from other rails of the drawer slide.

4. The drawer slide of claim 3, wherein a forward edge of the web includes an offset portion along an entire length of the forward edge of the web.

5. The drawer slide of claim 4, wherein a portion of a structure providing a raceway of the first rail is part of the offset portion of the forward edge of the web.

6. The drawer slide of claim 3, wherein the longitudinal web is circumferentially bounded by offset portions.

7. A drawer slide comprising:

a first rail, the first rail including a stop tab;

a second rail extendably coupled to the first rail, the second rail including a catch for engaging the stop tab to stop forward extension of the second rail; and a disconnect lever mounted on a forward portion of the first rail for constraining movement of the second rail in at least one direction with the disconnect lever in a first position, the disconnect lever movable to a second position to permit sufficient movement of the second rail in the at least one direction to allow the catch to pass by the stop tab;

with the second rail further including a feature configured to move the disconnect lever from the second position to the first position on retraction of the second rail with respect to the first rail.

8. The drawer slide of claim 7, wherein the feature configured to move the disconnect lever from the second position to the first position comprises an in-stop configured to stop rearward motion of the second rail with respect to the first rail.

9. The drawer slide of claim 8, wherein the in-stop comprises an upturned tab on the second rail.

10. A drawer slide comprising:

a first rail;

an intrusion in a raceway of the first rail;

a second rail extendably coupled to the first rail; and a moveable hook mounted to the second rail, with a bend of the hook extending, beyond a rearward edge of a lower raceway of the second rail, past a surface of a raceway of the second rail sufficiently far such that the intrusion in the raceway of the first rail is in a travel path of at least part of the hook with the hook in a first position, and out of the travel path of the hook with the hook moved to a second position;

with the intrusion in the raceway of the first rail positioned so as to set an extent of extension of the second rail with respect to the first rail.

11. The drawer slide of claim 10, wherein the bend of the hook is biased by gravity to extend past the surface of the raceway of the second rail.

12. The drawer slide of claim 10, wherein the hook is part of a hook block, with the hook block including a mid-length slot for placement of a spring to bias the bend of the hook to extend past the surface of the raceway of the second rail.

13. The drawer slide of claim 10 wherein:

the first rail has a longitudinal web; and the second rail has a longitudinal web, with a descending leg rearward of the hook;

with a V-shaped rear stop formed out of the web of the first rail, about a rear edge of the first rail, to engage the descending leg and provide a limit to rearward movement of the second rail.

14. The drawer slide of claim 13, wherein the V-shaped rear stop is in the form of a horizontal V-shape, with the V-shaped rear stop extending into a travel path of the web of the second rail.

* * * * *